United States Patent [19]

Manchak, Jr. et al.

[11] Patent Number: 5,043,103

[45] Date of Patent: Aug. 27, 1991

[54] METHOD AND APPARATUS FOR CENTRIFUGALLY CASTING HAZARDOUS WASTE

[76] Inventors: Frank Manchak, Jr.; Frank E. Manchak, II; Michael E. Manchak; Peter J. Manchak, all of P.O. Box 1309, Goleta, Calif. 93116

[21] Appl. No.: 328,020

[22] Filed: Mar. 23, 1989

[51] Int. Cl.[5] ..... G21F 9/12; G21F 9/24; B28B 1/02; B28B 1/20

[52] U.S. Cl. ..... 252/633; 252/628; 252/478; 250/506.1; 405/128; 405/129; 494/66; 494/85; 264/260; 264/270; 264/310; 264/311

[58] Field of Search ..... 252/628, 633, 632; 110/342, 237, 238; 250/506.1, 507.1; 405/128; 494/36, 37, 66, 67, 71, 85; 209/915, 148, 199; 264/260, 270, 310, 311

[56] References Cited

U.S. PATENT DOCUMENTS

| | | | |
|---|---|---|---|
| 4,230,660 | 10/1980 | Taylor et al. | 252/478 |
| 4,572,959 | 2/1986 | Popp et al. | 250/506.1 |
| 4,581,163 | 4/1986 | Meininger et al. | 252/633 |
| 4,642,186 | 2/1987 | Nakamura | 210/257.1 |
| 4,659,511 | 4/1987 | Fukasawa et al. | 252/631 |
| 4,681,705 | 7/1987 | Robertson | 252/631 |

*Primary Examiner*—Howard J. Locker
*Attorney, Agent, or Firm*—Roth & Goldman

[57] ABSTRACT

A casting containing toxic waste is made by centrifugally casting toxic waste in a pre-formed cage having heat conducting means therein. The casting is formed with suitable shielding materials selected as a function of the waste being cast. The finished casting contains passageways through which heat is removed. These passageways are oriented such that when two or more castings are stacked in abutment, the passageways of adjacent castings interconnect.

15 Claims, 3 Drawing Sheets

FIG. 5
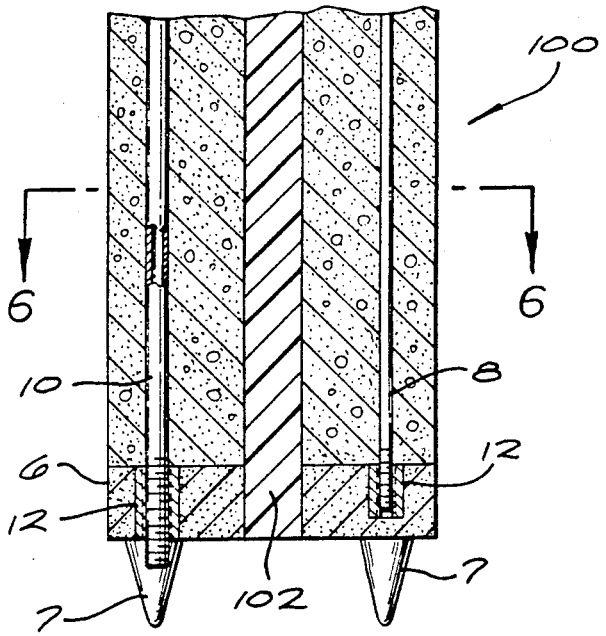
FIG. 6
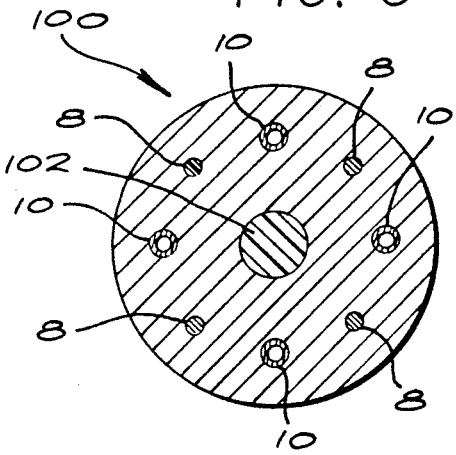
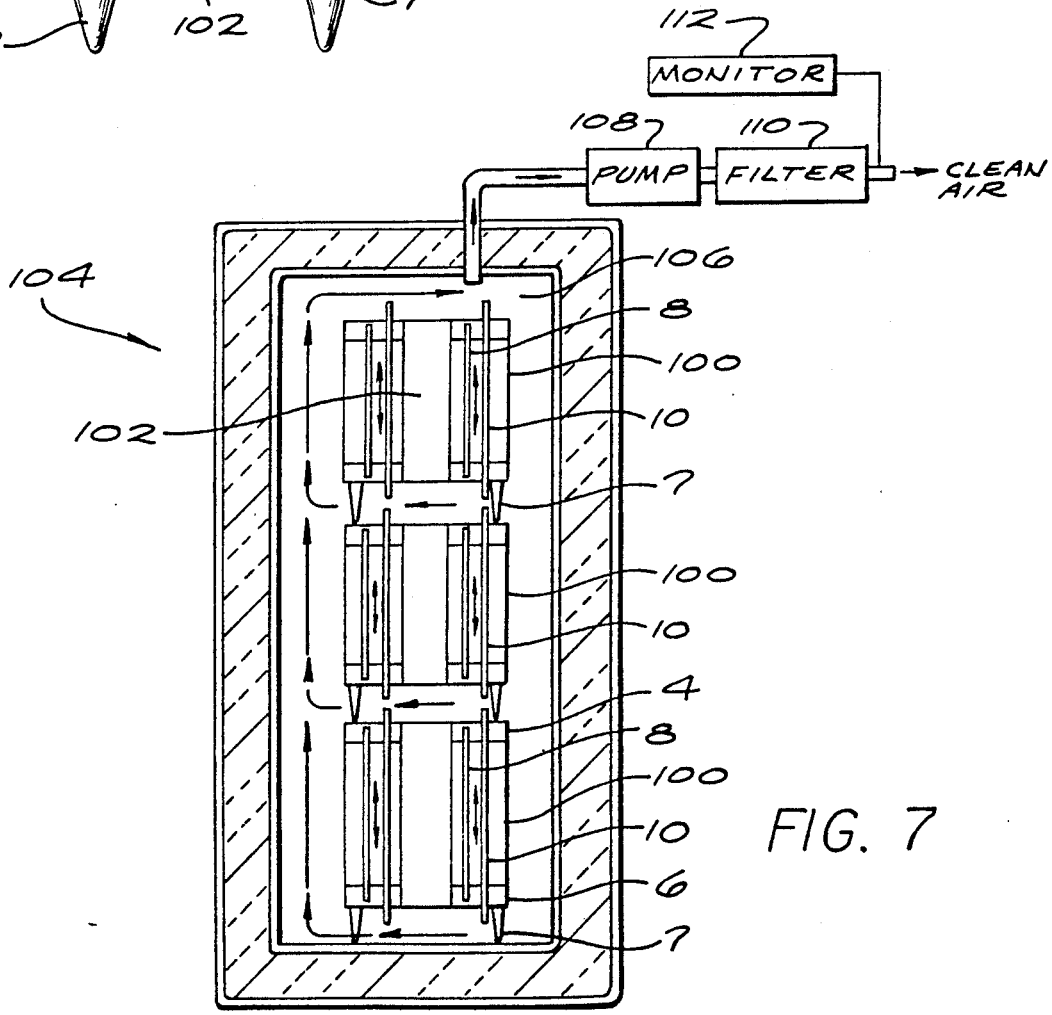
FIG. 7

METHOD AND APPARATUS FOR CENTRIFUGALLY CASTING HAZARDOUS WASTE

CROSS REFERENCE TO RELATED APPLICATIONS, IF ANY

None

BACKGROUND OF THE INVENTION AND PRIOR ART

This invention relates to casting toxic waste for burial or other suitable isolation. The cost of burying or isolating toxic wastes is increasing at an alarming rate due in part to stringent government regulations and sound environmental policy which dictate that toxic wastes cannot be simply dumped in a standard landfill.

Techniques for separation and isolation of mixed waste, particularly low-level radioactive wastes mixed with other hazardous constituents, are discussed in detail in co-pending U.S. patent application Ser. No. 07/160,814 filed Feb. 26, 1988 by Frank Manchak, Jr.

Some particularly hazardous toxic wastes, such as those wastes which are radioactive, must be stored in environmentally sound containers to effectively isolate the waste from the environment. These containers are often then stored in remote burial sites, suitable repositories or vaults. The use of standard metal drums or containers as containers for toxic waste is well known in the prior art. These drums are inappropriate for use with certain mixed wastes containing radioactive materials, and chemicals listed in 40 CFR Part 261, such as corrosives.

Since some waste such as waste from nuclear facilities must be isolated for thousands of years, the containers holding these wastes must last as long regardless of whether they are subjected to corrosive action from the contents within the containers or from the exterior environment such as salt water or other chemical attack which is frequently present in underground storage vaults.

Radioactive waste must be isolated with adequate shielding to protect persons handling the waste and the environment. The type of shielding required depends on the type of radiation emitted by the waste. The following are encountered:

Fast Neutrons

Fast neutrons are those neutrons with energies roughly above 1OO,OOO eV (electron volts). Hydrogen nuclei are an effective shielding material for fast neutrons.

Water is a good source of hydrogen, but it is not suitable for use as a long term shield in its free liquid form because of the danger of leaks. Concrete is also effective as a shield for fast neutrons because the bound water in concrete is a source of hydrogen nuclei and functions as a shielding agent.

Another suitable shielding material is polyethylene which contains more hydrogen atoms per cubic centimeter than any other substance.

Thermal Neutrons

Thermal neutrons are those neutrons with energies roughly below 0.025 eV. The most effective way to stop thermal neutrons is to shield with $B^{10}$ (Boron$^{10}$). $B^{10}$ may be mixed in its pure form directly with the waste, or it may be added in its powdered form to concrete to be used as a containment vessel for radioactive wastes. $B^{10}$ may further be suspended in polyethylene to form a combined shield for fast and thermal neutrons.

Gamma Rays

Gamma rays are quanta of electromagnetic wave energy having wavelengths from 0.005 to 1.40 Angstroms. Gamma rays are best shielded by elements with high atomic numbers, and lose energy by the Photoelectric Effect, Compton Scattering and Pair Reduction.

Alpha and Beta Radiation

An alpha particle is identical with the nucleus of the helium atom and consists therefore of two protons plus two neutrons bound together. A beta particle is identical with an ordinary electron. Both alpha and beta particles are strongly ionizing when moving and so lose energy rapidly in traversing through matter. Most alpha particle s will traverse only a few centimeters of air before coming to rest. While more shielding is generally necessary to stop beta particles than is required to stop alpha particles, nearly any container manufactured to isolate waste would provide sufficient shielding for both alpha and beta radiation.

Much of the high cost of burying or otherwise isolating toxic waste comes not directly from the mass of the waste, but rather from its volume. Space in suitable repositories is limited, so waste and shielding material must be packed as tightly as possible. There are various techniques currently used to compact toxic waste for isolation. Screw compactors and pelletizers are the most common devices, and the federal facility at Oakridge Tenn., a 100 ton compactor is used to compact waste into barrels. The volume reduction capabilities of these methods varies, but none of them is able to approach complete compaction to the maximum possible density.

As radioactive wastes decay, they produce heat, and the rate at which heat is produced in a mass of radioactive waste is generally related to the density of the wastes contained in a container thereof. Centrifugal castings are very dense, and heat production in the casting causes various problems.

In a densely cast mixture of radioactive waste and shielding material without internal heat removal means, a symmetrical casting is ordinarily hottest in its center, and its temperature decreases towards its outer periphery. Extreme temperature gradients existing between the center of the casting, and its outer periphery are likely to cause the casting to crack due to thermal stresses. Also, shielding materials such as polyethylene will chemically degrade if the temperature of the casting rises above about 400° F.

Most underground repositories, or vaults for storing radioactive wastes have been placed in rock formations deep below the earth's surface. The heat Which is produced by the radioactive wastes stored in these vaults builds up to intolerable levels because it can not dissipate through the surrounding rock. If this heat is not removed, the temperature of the entire underground repository will rise beyond a level where human beings cannot work and containers of radioactive waste will melt or crack thus releasing radioactivity. Also, any volatile components present in the radioactive waste will volatilize, and can easily carry radiation into the water table or atmosphere.

OBJECT OF THE INVENTION

It is therefore the object of the present invention to provide a method and apparatus to densely compact mixtures of toxic waste and shielding materials into a rigid form and to provide means for removing heat from the compacted form such that the compacted form does not crack due to thermal stresses.

SUMMARY OF THE INVENTION

The present invention accordingly provides for centrifugally casting a castable mixture containing toxic waste into a stable casting of high density. The method involves selecting an outer castable shielding barrier of optimum composition and thickness for the specific waste to be isolated. Centrifugal casting is ideal for this purpose because in centrifugal casting, the thickness or the outer shielding barrier, as well as the materials from which the outer shielding barrier is formed, may be easily changed as the casting process progresses.

The method further enables easily varying the dimensions of the toxic waste casting by selecting a mold with the desired diameter, and by using different sized preformed blanks, or cages which are incorporated into and define the length of the casting to allow castings to be easily custom built to minimize wasted dead space in a repository.

The method and apparatus disclosed herein also provide for the efficient removal of heat from the finished castings and storage repository. Means are provided to maintain the temperature of the castings below critical temperature s above which concrete, if used in the casting, may crack or otherwise release radioactive materials or lose water of crystallization, and temperatures above which radioactivity shielding materials, such as polyethylene, may thermally degrade over time.

BRIEF DESCRIPTION OF THE DRAWING

FIG. 5 is a sectional view of a completed casting.

FIG. 6 is a cross section taken along line 6—6 of FIG. 5.

FIG. 7 is a diagrammatic view of the heat flow from stacked castings in a repository.

DESCRIPTION OF THE PREFERRED EMBODIMENT

Figure 1:
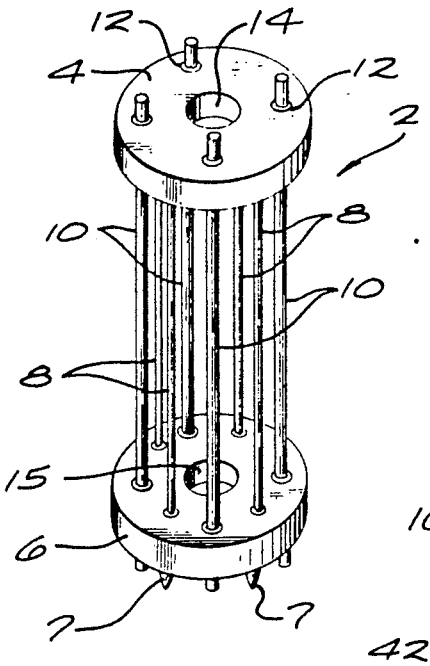
FIG. 1 is a perspective view or a precast reinforcing and heat removal cage used in centrifugal casting of hazardous waste.

FIG. 1 shows a consumable cage 2 which will become part of the casting of hazardous waste materials formed by centrifugal casting methods disclosed below. As shown, the cage 2 has a pair of spaced precast concrete disks, or end pieces 4, 6, the lower one of which may have feet 7 thereon for stacking the castings in a vertically spaced relationship. These end pieces 4, 6 will have boron or polyethylene or other suitable shielding materials cast therein in amounts adequate to shield radioactivity emissions from the wastes to be cast. Boron enriched polyethylene may be used as a combined shield. It will be appreciated by persons skilled in the art that, while cylindrical end pieces 4, 6 have been shown, other generally symmetrical shapes such as octagonal shapes can also be used. The precast end pieces 4, 6 are fastened together at a desired axial spacing from each other by a plurality of alternately spaced solid heat conductive reinforcing rods 8 of steel, ceramic material or graphite, and heat conducting conduits 10 arranged in a generally circular pattern. Advantageously, one end of each rod 8 and conduit 10 is provided with a right hand thread with the other end being provided with a left hand thread. The threaded rods 8 and conduits 10 are received in mating threaded inserts 12 best seen in FIG. 5. The inserts 12 for the conduits 10 are designed to allow the heat conduits 10 to extend entirely through the end pieces. The ends of there reinforcing bars 8 may be embedded within the end pieces 4, 6 or, like the conduits 10, may extend entirely through the end pieces 4, 6 for a purpose to be described. The threading on the conduits 10 and the inserts 12 in the end pieces 4, 6 is selected such that the conduits 10 can be easily affixed to both end pieces 4, 6 simultaneously by rotating the conduits 10 in the desired direction. The rods 8 may be similarly affixed to the end pieces 4, 6 if desired. End piece 4 is also provided with a circular central aperture 14 for receiving a casting feed mandrel 16 which will be described below.

Our presently preferred heat conduits 10 comprise heat pipes, as that term is understood in the mechanical engineering field, with ammonia, water or other known working fluids. Heat pipes suitable for the intended purpose are commercially available from Thermacore, Inc. of Lancaster, Penna. It is to be understood that suitable heat conduits 10 could also comprise hollow piping.

Figure 2:
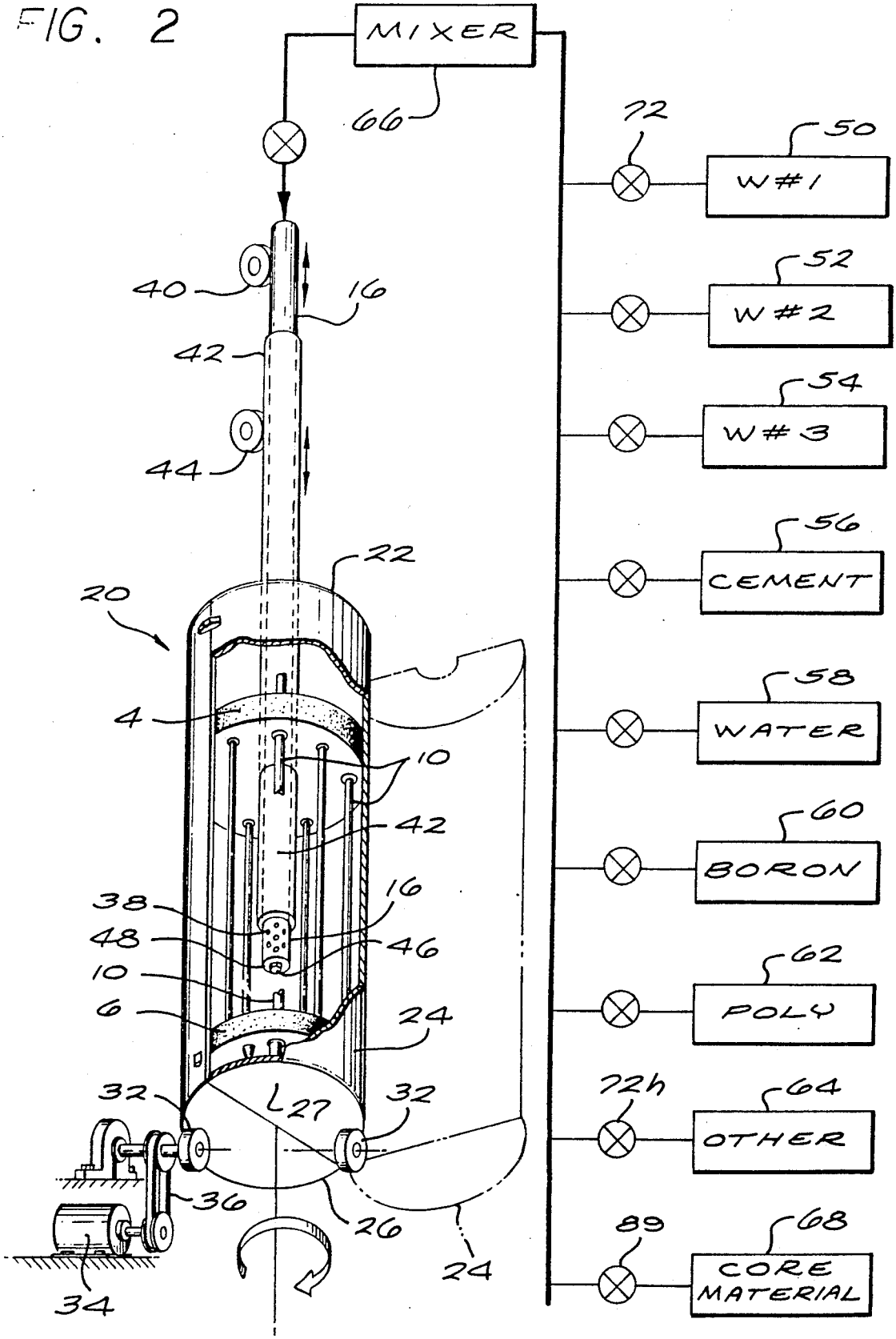
FIG. 2 is a schematic perspective view of a centrifugal casting apparatus Which receives the cage of FIG. 1 preparatory to centrifugal wasting of waste.

As seen in FIG. 2, the casting apparatus 20 comprises a vertically oriented cylindrical mold shell 22 preferably comprised of two halves 24, 26 which can be opened to the dash line position shown to receive a cage 2 of the selected length. It will be appreciated that the casting apparatus 20 may belong enough to produce castings having an axial length of approximately ten feet, although castings to be produced may typically have an axial length of only six feet with a diameter of three feet. The castings can, however, be made in any desirable length less than ten feet by simply using a cage 2 of the selected length.

The mold shell halves 24, 26 are hingedly connected and latched together When close d. A pair of disk shaped end pieces 25, 27 close the upper and lower ends of the mold 22. Upper end piece 25 may be omitted if desired. The entire mold 22 is driven by a roller drive 32 and can be rotated at speeds sufficient to create a centripetal acceleration at the periphery of the mold of about sixty times the acceleration due to gravity by a drive mechanism consisting of a motor 34 and power transmission 36.

As shown, the elongated, generally cylindrical feed mandrel 16 extends centrally through the central aperture 14 in the upper end piece 4 of the casting apparatus 20 and is provided with a plurality of radial ports 38 for the discharge of castable materials into the interior of the rotatable casting apparatus 20. A mandrel drive mechanism 40 is shown schematically for longitudinally moving the elongated hollow mandrel 16 into and out of the cylindrical mold shell 22. It will be appreciated that the feed mandrel 16 could alternatively be arranged to feed castable materials into the mold at a location spaced radially from the axis of rotation of the mold so long as a suitable rotatable swivel fluid connection is used. Such an arrangement is well known and is necessary if the prefabricated cage 2 is also provided with a central heat removal core 102 prior to commencement or the centrifugal casting as will be described below. When a core 102 is prefabricated with the cage 2, the feed mandrel 16 must be radially offset away from the core 102 and must extend downwardly into the mold shell 22 either through a radially offset aperture (not shown) in the upper end piece 4 of the cage 2 or into a radial clearance apace left between the periphery of the upper end piece 4 and the interior wall surface of the mold shell 22.

A mandrel sleeve 42 is telescopingly engaged with the hollow ported mandrel 16 and is separately moved longitudinally by a sleeve drive 44. In addition to radial ports 38 on the mandrel 16, an axially oriented central core casting port or ports 46 are also provided at the lower end 48 of the mandrel 16 which is inserted into the mold shell 22. Presently, we prefer to use a pre-cast heat conducting central core 102 manufactured of carbon and epoxy, or ceramics. This core 102 may be provided as an integral part of cage 2. Alternatively, a removable plug may be placed in the casting mold 22 before casting commences. After casting is completed, the plug is removed and replaced with a precast heat conducting core 102. Alternatively, the core 102 may be cast in the mold 22, as explained in detail below.

The materials to be cast in the centrifugal casting apparatus are stored In one or more separate containers of hazardous waste 50, 52, 54, portland cement 56, water 58, radioactivity shielding materials such as boron pellets 60, polyethylene 62 or other types of shielding materials 64 to be intimately mixed in a hopper 66 in selected portions. Also shown as an option to the use of a pre cast central core is a container 68 of castable ceramic core material to be injected into a central hollow void space which re mains in the casting after the feed mandrel 16 is removed to form a core 70. A plurality of valves 72*a–h*, 89 control the discharges from the various sources of casting feed and, as will be appreciated by those skilled in the art, such valves 72*a–h* can be remotely controlled electronically so that the composition and the thickness of the shielding materials and hazardous wastes can be accurately measured and controlled as desired.

The thickness of concrete to be used as an outer barrier and the proportions of radioactivity shielding material therein depends greatly on the properties of the radioactive waste to be cast. The American Nuclear Society has published guidelines on the analysis and design of concrete radiation shielding. These guidelines were approved by the American National Standards Institute, Inc. (ANSI), and are available as ANSI/ANS-6.4-1985.

Figure 3:
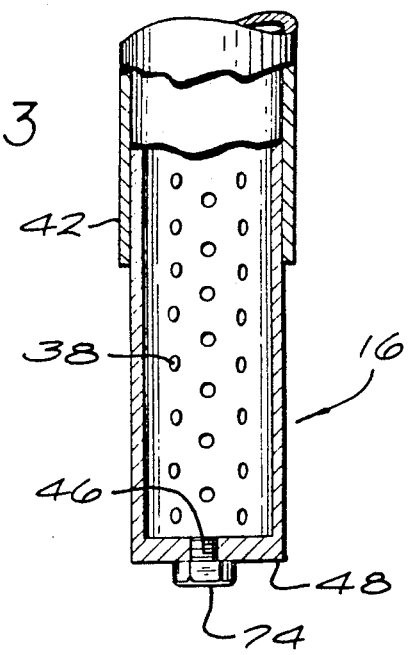
FIG. 3 is a detail view of the injection feed mandrel use with the casting apparatus of FIG. 2.
Figure 4:
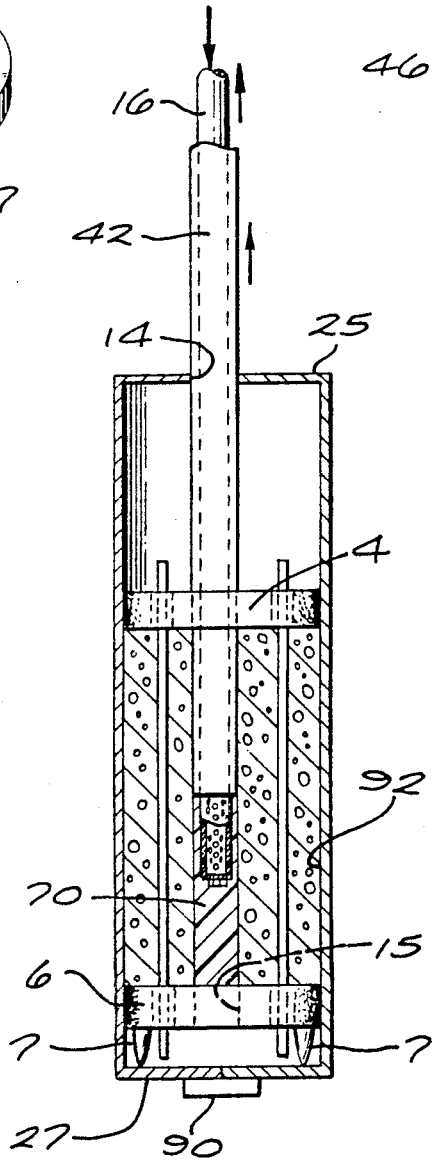
FIG. 4 is a sectional view of centrifugal casting apparatus mandrel shown in FIG. 2.

The details of the injection mandrel 16 are best seen in FIGS. 3 and 4. The mandrel 16 is provided with a plurality of radial injection ports 38 which have been uncovered by partial withdrawal of the mandrel sleeve 42. A manually removable plug 74 is provided at the axial end 48 of the mandrel 16 for opening the port 46 therein which is used for the discharge of castable carbon and epoxy, or ceramic heat conductive central core material when desired. Since a cylindrical mandrel aperture 14, 15 has been left at either end of the precast, consumable cage 2, a temporary cover 90 is provided which is removably affixed to the mold end piece 27 in any convenient manner after opening of the mandrel plug 74 so that the castable ceramic material will not escape through end piece 6 of the casting as it is injected into the hollow central core 70. The mandrel 16 is removed from the top end of the central core 70 as the castable ceramic material is injected into the bottom end of the hollow core 70 and gradually fills same.

Finished castings 100 may be vertically stacked in a repository vault as seen in FIG. 7 and are spaced from each other by the feet 7. Although it is possible to use heat removal conduits 10 which are hollow and may be aligned for continuous unidirectional flow of heat transfer fluid therethrough, we presently prefer to use heat pipes which are believed more economical and efficient. Since the heat flow in heat pipes may be bi-directional with heat being removed from either end of each casting 100 as shown by the heat flow arrows, we presently prefer to stack the castings 100 in the repository with a sufficient vertical spacing therebetween so as to permit heat removal from the exposed ends of the heat pipes. The exposed ends of the heat pipes transfer heat laterally to vertically extending heat removal spaces between or alongside of the castings by forced air currents as shown by the heat flow arrows in FIG. 7.

OPERATION

For the casting of hazardous materials to be disposed of, the cylindrical mold shell halves 24, 26 are unlatched and opened. Subsequently, a precast, consumable cage 2 or the desired length, which may or may not also have a pre-cast central core 102 therein, is deposited in the casting mold shell 22 adjacent the lower end piece 27. The mold shell 22 is then closed to hold the cage 2 in the desired position by clamping engagement with the mold shell 22 which is then latched and subsequently brought to the desired speed of rotation by the drive motor 84 and power transmission 36. Next, the feed mandrel 16 and sleeve 42 are simultaneously longitudinally moved into the rotating mold 22 and through the mandrel aperture 14 of the upper end of the cage 2. The sleeve 42 is then retracted from the mandrel 16 a distance equal to the axial length of the cage 2 so as to expose mandrel ports 38 extending axially between the spaced parallel end pieces 4, 6 of the precast cage 2. Subsequently, the appropriate valves 72*a–h* are opened to transmit the castable materials under pressure into the mandrel 16 where they are radially ejected from the mandrel ports 88 and centrifugally cast against the inner walls 92 of the rotating cylindrical mold shell 22. After the desired outer layer thickness of mixed concrete and shielding materials has been attained, the valves 72*a–h* are adjusted to transmit a mixture of the hazardous materials to be cast in the rotating cage 2. If desired, the radially innermost layer of the casting is completed by again using a higher proportion of concrete and shielding materials.

While FIG. 2 shows a centrifugal casting apparatus 20 designed to rotate about the longitudinal axis of the mold shell 22, mold shell 22 may also be caused to rotate such that its ends oscillate about an axis perpendicular to its longitudinal axis. A centrifugal casting apparatus having multi-axis rotation is of particular advantage When casting shapes other than cylindrical castings—e.g. castings having hexagonal or octagonal cross sections. A suitable multi-axis centrifugal casting apparatus is manufactured by FSP Machinery Co. of Winkler, Manitoba, Canada.

Upon completion of the casting process, the mandrel 16 and sleeve 42 are removed from the mold shell 22, and rotation of the cylindrical mold shell 22 is terminated. A pre-cast heat conductive core 102 is inserted into the void left by removal of the mandrel 16, and sleeve 42.

While the casting has been described as having an outer layer of shieiding mate rials with toxic waste contained therein, persons skilled in the art will appreciate that the casting could be formed as a homogeneous mass of toxic waste and shielding materials and that shapes other than cylindrical can be centrifugally cast if desired.

If it is desired to form the central heat removal core 102 by casting, upon completion of the centrifugal casting process, the sleeve 42 is moved downwardly to completely cover the radial ports 38 in the mandrel 16 and rotation of the cylindrical mold shell 22 is terminated. The mandrel end plug 74 is then opened exposing the axial port 46 at the lower end of the mandrel 16 and, subsequently, the temporary cover 90 is affixed to close the aperture 15 at the lower e nd of the cylindrical mold shell 2 and end of the casting. Finally, the valve 89 is opened to permit castable ceramic material to discharge through the mandrel 16 where it is ejected from axial port 46 in the end of mandrel 16 against the temporary cover 90. Pressure buildup caused by the injection process assists in axially withdrawing the mandrel 16 and sleeve 42 simultaneously from the mold shell 22. The ceramic core injection is terminated when the mandrel 16 and sleeve 42 have been withdrawn a distance equal to the axial length of the mold shell 22.

The completed casting 100 is then removed from the mold shell 22 and, as seen in FIGS. 5 and 6, the completed casting 100 has both ends of heat conduits 10 which comprise heat pipes, and the central ceramic core 102 exposed so that, when stacked as shown in FIG. 7, the he at conduits 10 and central core 102 can be arranged to permit heat removal from the exposed ends of the heat conduits 10 and the central core 102 by forced air currents to air space 106.

Since hollow conduits or solid bars, rather than heat pipes, may be used as heat conduits 10, the he at conduits 10 and central cores 102 in vertically adjacent stacked castings can be arranged in direct contact with each other for efficient heat transfer relationship with each other to remove the generated heat upwardly through the conduits in the vertically adjacent castings rather than laterally through the spaces left by the feet 7 thence upwardly into air space 106.

it has been estimated that even after thirty years of isolation in a repository, nuclear waste may still release heat flow of the order of magnitude about ninety times the normal heat flow through the earth. Unless heat is adequately removed, waste containing strata will rise in temperature until long term equilibrium is re ached and the heat generated by the repository 104 equals heat flow to the earth's surface.

It is thus important to provide for regular and efficient heat removal from underground repositories. To this end, as seen in FIG. 7, heated air is removed from the air space 106 by a pump 108 and is passed through a High Efficiency Particle Air (HEPA) filter 110 so that the contaminant content of the air may be carefully monitored at 112 before it is discharged to the atmosphere.

It will be appreciated, that in some instances it will be desired to use a plurality of hollow heat conduits 10 and no solid reinforcing rods s to space the end pieces 4, 6 of the precast cage 2. Depending on the characteristics of the waste to be handled, a greater or lesser proportion of the axially arranged heat conduits 10 will be used instead of solid reinforcing bars 8.

Persons skilled in the art will readily appreciate that various modifications can be made from the preferred methods and apparatus disclosed herein, thus the scope of protection is to be defined only by the limitations of the appended claims.

We claim:

1. A method of compacting hazardous waste materials into a stable rigid form comprising the steps of:

a) placing a cage comprised of a pair of end pieces spaced from each other and a plurality of spaced heat conductors interconnecting said end pieces into a rotatable casting mold and affixing said cage in position therein, said cage having a central longitudinal axis;

b) rotating said mold and cage about said longitudinal axis;

c) injecting a first castable mate rial into said rotating mold and centrifugally casting said first material to form a cast outer barrier of a desired radial thickness;

d) injecting a second castable hazardous material into said mold and centrifugally casting said second material radially inwardly of said first material;

e) terminating said injection and centrifugal casting of said second material when the radial distance between said central axis and said second material reaches a predetermined f) providing a central heat conductive core of a desired diameter which extends between and through said end pieces and along said central axis; and g) removing the resulting casting comprised of said cage and said castable materials from said mold.

2. The method as in claim 1, wherein the step of providing a heat conductive central core comprises providing said prefabricated cage with a heat conductive central core prior to said centrifugal casting.

3. The method as in claim 1, wherein the step of providing a heat conductive central core comprises the steps of placing a removable plug extending between and through said end pieces and along said central axis in said mold, and further comprises the steps of:

a) removing said plug after terminating said injection and centrifugal casting of said second material and leaving a void therein; and b) placing a pre-fabricated heat conductive core in said void.

4. The method as in claim 1, wherein the step of providing a central core comprises inserting a feed mandrel into said mold along said central axis and further comprises the steps of:

a) injecting castable core material through said feed mandrel; and b) axially removing said mandrel from said mold leaving a generally cylindrical void in the casting material therein.

5. The method as in claim 4, wherein said core heat conductive material is injected into a void in said casting at one end of said mandrel under sufficient pressure to create a force on said end of said mandrel to assist removal of said mandrel.

6. The method as in claim 1, wherein said hazardous waste is radioactive waste.

7. A centrifugally formed casting having a pair of ends and a central longitudinal axis, said casting containing toxic waste and means for re moving heat therefrom comprising:

a) two spaced end pieces;

b) a plurality of spaced, heat conductive connecting means connecting, and extending between and through said end pieces;

c) a first castable material extending between said casting ends and forming an outer layer of the casting;

d) a second castable material disposed inside of said first castable material comprising hazardous waste extending between said casting end pieces; and e) a heat conductive core disposed inside of said second castable material and extending along said central axis.

8. A casting as in claim 7, wherein at least some of said heat conductive means are hollow.

9. A casting as in claim 7, wherein said heat conductive means are heat pipes.

10. A casting as in claim 7, wherein said first castable material is concrete.

11. A casting as in claim 7, wherein said first castable material contains a radiation shielding material.

12. A casting as in claim 7, wherein said second castable material further comprises a radiation shielding material.

13. A casting as in claims 11 or 12, wherein said radiation shielding material comprises boron enriched polyethylene.

14. A casting as in claim 7, wherein said heat conductive core comprises a carbon and epoxy mixture.

15. A casting as in claim 7, wherein said heat conductive core comprises a ceramic.

* * * * *